US006994786B2

(12) United States Patent
Cameron et al.

(10) Patent No.: US 6,994,786 B2
(45) Date of Patent: Feb. 7, 2006

(54) PHOSPHATE BENEFICIATION PROCESS USING METHYL OR ETHYL ESTERS AS FLOAT OILS

(75) Inventors: Timothy Bruce Cameron, Mulberry, FL (US); Guoxin Wang, Lakeland, FL (US)

(73) Assignee: ARR-MAZ Products, L.P., Winter Haven, FL (US)

( * ) Notice: Subject to any disclaimer, the term of this patent is extended or adjusted under 35 U.S.C. 154(b) by 67 days.

(21) Appl. No.: 10/862,478

(22) Filed: Jun. 7, 2004

(65) Prior Publication Data

US 2005/0269248 A1 Dec. 8, 2005

(51) Int. Cl.
*B03D 1/02* (2006.01)

(52) U.S. Cl. ..... 210/166; 252/61

(58) Field of Classification Search ..... 209/166; 252/61

See application file for complete search history.

(56) References Cited

U.S. PATENT DOCUMENTS 2,300,827 A * 11/1942 Christmann et al. ..... 209/166
2,377,129 A * 5/1945 Christmann et al. ..... 209/166
2,416,909 A * 3/1947 Crawford et al. ..... 209/166
3,098,817 A * 7/1963 Baarson et al. ..... 209/166
4,200,522 A * 4/1980 Dorrepaal et al. ..... 209/166
4,227,996 A 10/1980 Levine et al.
4,358,368 A 11/1982 Hellsten et al.
4,523,991 A 6/1985 Meyer et al.
4,545,898 A 10/1985 Hellsten
4,732,667 A 3/1988 Hellsten et al.
4,790,931 A 12/1988 Koester et al.
4,795,578 A 1/1989 Hellsten et al.
4,830,739 A 5/1989 Hellsten et al.
4,968,415 A * 11/1990 Morawietz et al. ..... 209/166
5,057,209 A 10/1991 Klimpel et al.
5,108,585 A 4/1992 von Rybinski et al.
5,542,545 A * 8/1996 Yu ..... 209/166
6,077,389 A 6/2000 Sawai et al.
6,145,667 A 11/2000 Rothenberg et al.
6,409,022 B1 6/2002 Rothenberg et al.
6,685,027 B2 2/2004 Yap
2002/0148759 A1 10/2002 Rothenberg et al.

* cited by examiner

*Primary Examiner*—Thomas M. Lithgow
(74) *Attorney, Agent, or Firm*—Dennis G. LaPointe

(57) ABSTRACT

A process for use in a phosphate ore beneficiation process to minimize the long-term environmental impact of the use of petroleum based hydrocarbon materials mixed with fatty acid based primary floatation reagents for froth flotation in the flotation of phosphate ores, wherein the process comprises substituting the petroleum based hydrocarbon materials with methyl and/or ethyl esters of fatty acids.

6 Claims, No Drawings

PHOSPHATE BENEFICIATION PROCESS USING METHYL OR ETHYL ESTERS AS FLOAT OILS

FIELD OF THE INVENTION

The present invention relates to a phosphate ore beneficiation process, which includes a more ecologically acceptable replacement for the petroleum based fuel or reclaimed oil commonly used as part of the primary collection process.

BACKGROUND OF THE INVENTION

Apatite is the name applied to a group of calcium phosphate minerals containing other elements or radicals. The mineral occurs in the United States mainly in the form of the calcium phosphate ores that are referred to generically as phosphate rock. Phosphate rock is rock that consists of calcium phosphate largely in the form of the aforementioned apatite together with clay, quartz, and other non-valuable minerals, and is useful in fertilizers and as a source of phosphorus compounds. It occurs in large beds in the southeastern and the northwestern U.S.

The calcium phosphate is normally separated from other constituents of the ore by froth flotation. The de-slimed and sized calcium phosphate is floated from a slurry by aeration with the aid of one or more flotation agents. Most widely used flotation agents/collectors are the unsaturated fatty acids, for example, oleic acid, and the technical grades or commercial grades of naturally-occurring fatty acid mixtures having a high proportion of unsaturated fatty acids derived from such oils as such as tall oil, corn oil, safflower oil, soybean oil, cottonseed oil, and linseed oil, and derivatives thereof, as well as synthetic acids. The flotation effect of the fatty acids is usually enhanced by mixing in a similar amount of a petroleum-based hydrocarbon, such as diesel oil, #5 fuel oil, or reclaimed oil, which sometimes contains a small amount of a nonionic or anionic emulsifier. The use of such petroleum-based hydrocarbons is causing concern because eventually part of the process water and all of the flotation "tailings" are returned to the environment whereby the petroleum hydrocarbons could enter waterways and aquifers. Unlike the fatty acid based components, fuel oil and reclaimed oils may contain fractions that are non-biodegradable and can contain hazardous polynuclear aromatics.

DESCRIPTION OF THE INVENTION

It has been found that the petroleum-based hydrocarbons can be replaced by methyl and/or ethyl esters of fatty acids without adversely effecting the flotation process. Such esters are produced from animal and vegetable renewable resources and are readily biodegraded. Specifically, the ester substitution is more fully described below.

More specifically, the present invention is a process for use in a phosphate ore beneficiation process. It is a method for minimizing the long-term environmental impact of the use of petroleum-based hydrocarbon materials mixed with fatty acid based anionic flotation reagents for froth flotation in the flotation of phosphate ores, and comprises substituting said petroleum based hydrocarbon materials with methyl and/or ethyl esters of fatty acids.

The esters of fatty acids are derived from:

an oil obtained from one of rapeseed, sunflower, corn, safflower, soybean, and fatty acids obtained from said oils;

fatty acids derived from tall oil including heads and crude tall oil;

and combinations thereof.

The methyl or ethyl esters and combinations thereof are derived from animal, plant and synthetic materials esters.

When the fatty acid is a crude tall oil and residual rosin acids interfere with the flotation process, the residual rosin acids remaining after esterification are reacted with an alkaline earth base in stoichiometric quantities to neutralize the acid.

When an increase in viscosity occurring by the neutralization process is undesirable, a desired proportion of non-crude tall oil derived methyl or ethyl ester is added to reduce the viscosity to an acceptable level.

The methyl and/or ethyl esters are blended with the fatty acid based primary floatation reagents in a proportional ratio of from about 25:75 to 75:25.

The blended esters and reagents are added to a deslimed and sized phosphate rock slurry at a level normally about 0.3 to 3.0 pounds per ton of dry feed.

DETAILED DESCRIPTION OF THE INVENTION

This disclosure describes the use of methyl and/or ethyl fatty acid esters as a component of anionic flotation reagents to replace petroleum derived hydrocarbons such as diesel oil, #5 fuel oil or reclaimed oil.

The methyl and/or ethyl esters useful in the present invention can be prepared by methods known in the art whereby the appropriate alcohol is reacted with an oil such as rapeseed, sunflower, corn, safflower, and soybean, fatty acids obtained from these oils, or tall oil derived fatty acids including heads and crude tall oil.

In the event that a crude tall oil is the source of the fatty acids, it is difficult to react the rosin acids to completion within a reasonable time or without using extreme conditions of temperature and pressure. It has been found that such residual rosin acids interfere with the flotation process and as an alternative to driving the reaction to near completion by the methods described above, can be effectively neutralized by the addition of a stoichiometric amount of calcium oxide or hydroxide. The resultant increase in viscosity by this reaction may also be undesirable in some cases so a proportion of a non-crude tall oil derived methyl or ethyl ester can be added to reduce the viscosity to a more acceptable level.

The esters described in this patent are blended with the fatty acid based anionic flotation reagent in a proportion from 25:75 to 75:25 and added to the deslimed and sized phosphate rock slurry at a level normally about 0.3 to 3.0 pounds per ton of dry feed.

The effectiveness of flotation reagents can be demonstrated in the laboratory by the use of a scaled down flotation cell to simulate full-scale production unit conditions.

EXAMPLE 1

A sample of the methyl ester of soybean fatty acids (biodiesel) was obtained from World Energy. The acid value was 0.07 mg KOH/g. This was mixed with a commercial fatty acid flotation reagent Custofloat 20 manufactured by Arr-Maz Custom Chemicals in the proportion 75:25 fatty acid:ester. A similar formulation replacing the ester with #5 fuel oil was prepared for comparison purposes.

Flotation experiments were conducted in a 3-liter Denver cell using feed obtained from Central Florida phosphate mine 1. A sample of about 700 g feed, accurately weighed, was first conditioned at 70% solids with 0.20 g (equivalent to 0.59 pounds/ton of feed) of the formulated flotation reagent for 90 seconds at 900 rpm. The sample was then diluted to 20% solids and floated at 1500 rpm for 60 seconds. The froth product and the flotation tailings were dried, weighed, and analyzed for $P_2O_5$ content by a spectroscopic method. Results were expressed as BPL (bone phosphate lime).

| | Feed | | Concentrate | | Tails | | Recovery |
|---|---|---|---|---|---|---|---|
| Reagent | Weight | BPL % | Weight | BPL % | Weight | BPL % | % |
| Fatty acid/Ester | 677.2 | 11.3 | 109.0 | 60.0 | 568.2 | 1.90 | 85.8 |
| Fatty acid/#5 Fuel oil | 674.2 | 11.3 | 106.2 | 59.3 | 567.8 | 2.37 | 82.4 |

EXAMPLE 2

A methyl ester of tall oil heads was prepared by refluxing an excess of methanol with a tall oil heads of acid value 141.7 mg KOH/g using an acid catalyst. The product was separated, washed, and dried and had a final acid value of 4.5 mg KOH/g. This was mixed with a commercial fatty acid flotation reagent Custofloat 18G manufactured by Arr-Maz Custom Chemicals in the proportion 60:40 fatty acid:ester. A similar formulation replacing the ester with #5 fuel oil was prepared for comparison purposes.

Flotation experiments were conducted in a 3-liter Denver cell using feed obtained from Central Florida phosphate mine 2. A sample of about 700 g feed, accurately weighed, was first conditioned at 70% solids with 0.40 g (equivalent to 0.75 pounds/ton of feed) of the formulated flotation reagent for 90 seconds at 900 rpm. The sample was then diluted to 20% solids and floated at 1500 rpm for 60 seconds. The froth product and the flotation tailings were dried, weighed, and analyzed for $P_2O_5$ content by a spectroscopic method. Results were expressed as BPL (bone phosphate lime).

| | Feed | | Concentrate | | Tails | | Recovery |
|---|---|---|---|---|---|---|---|
| Reagent | Weight | BPL % | Weight | BPL % | Weight | BPL % | % |
| Fatty acid/Ester | 679.1 | 16.6 | 182.6 | 55.6 | 496.5 | 2.26 | 90.0 |
| Fatty acid/#5 Fuel oil | 680.8 | 16.7 | 194.7 | 53 | 486.1 | 2.19 | 90.6 |

EXAMPLE 3

A methyl ester of crude tall oil was prepared by refluxing an excess of methanol with a crude tall oil of acid value 123.5 mg KOH/g using an acid catalyst. The product was separated, washed, and dried and had a final acid value of 55.0 mg KOH/g. The ester was heated to 230° F. and sufficient CaO added to yield an essentially neutral product. The rather viscous product was mixed with the tall oil heads ester in Example 2 in the proportion of 75 to 25 parts by weight to yield a product having a similar viscosity to #5 fuel oil. This was mixed with a commercial fatty acid flotation reagent Custofloat 18G manufactured by Arr-Maz Custom Chemicals in the proportion 60:40 fatty acid:ester. A similar formulation replacing the ester with #5 fuel oil was prepared for comparison purposes.

Flotation experiments were conducted in a 3-liter Denver cell using feed obtained from Central Florida phosphate mine 3. A sample of about 700 g feed, accurately weighed, was first conditioned at 70% solids with 0.49 gm (equivalent to 1.4 pounds/ton of feed) of the formulated flotation reagent for 90 seconds at 900 rpm. The sample was then diluted to 20% solids and floated at 1500 rpm for 60 seconds. The froth product and the flotation tailings were dried, weighed, and analyzed for $P_2O_5$ content by a spectroscopic method. Results were expressed as BPL (bone phosphate lime).

| | Feed | | Concentrate | | Tails | | Recovery |
|---|---|---|---|---|---|---|---|
| Reagent | Weight | BPL % | Weight | BPL % | Weight | BPL % | % |
| Fatty acid/Ester | 695.6 | 13.96 | 140.7 | 62.0 | 554.9 | 1.78 | 89.8 |
| Fatty acid/#5 Fuel oil | 695.6 | 13.96 | 144.7 | 61.0 | 550.9 | 1.60 | 90.9 |

What is claimed is:

1. In a phosphate ore beneficiation process, a method for minimizing the long-term environmental impact of the use of petroleum based hydrocarbon materials mixed with fatty acid based anionic flotation reagents for froth flotation in the flotation of phosphate ores, the method comprising:

substituting said petroleum based hydrocarbon materials with methyl and/or ethyl esters of fatty acids and wherein the methyl and/or ethyl esters of fatty acids are blended with fatty acid based primary flotation reagents in a proportional ratio of from about 25:75 to 75:25.

2. The method according to claim 1, wherein the esters of fatty acids are derived from:

an oil obtained from one of rapeseed, sunflower, corn, safflower, soybean, and fatty acids obtained from said oils;

tall oil derived fatty acids including heads and crude tall oil;

and combinations thereof.

3. The method according to claim 1, wherein the methyl or ethyl esters and combinations thereof are derived from animal, plant and synthetic materials.

4. The method according to claim 2, wherein when the fatty acid is a crude tall oil and residual rosin acids interfere with the flotation process, said residual rosin acids remaining after esterification are reacted with an alkaline earth base in stoichiometric quantities to neutralize the acid.

5. The method according to claim 4, wherein when an increase in viscosity occuring by the neutralization process is undesirable, a desired proportion of non-crude tall oil derived methyl or ethyl ester is added to reduce the viscosity to an acceptable level.

6. The method according to claim 1, wherein the blended esters and reagents are added to a deslimed and sized phosphate rock slurry at a level normally about 0.3 to 3.0 pounds per ton of dry feed.

* * * * *